US006070637A

United States Patent [19]

Jancan

[11] Patent Number: 6,070,637

[45] Date of Patent: Jun. 6, 2000

[54] HORIZONTALLY OPENABLE WINDOW

[76] Inventor: Marty Jancan, 5415 Heathdale, Azusa, Calif. 92672

[21] Appl. No.: 09/127,493

[22] Filed: Jul. 31, 1998

Related U.S. Application Data

[60] Provisional application No. 60/054,356, Jul. 31, 1997.

[51] Int. Cl.[7] ..... E06B 7/16

[52] U.S. Cl. ..... 160/40; 160/97; 160/188; 49/505

[58] Field of Search ..... 160/37, 38, 39, 160/40, 5, 98, 21, 97, 102, 188, 239, 310, 352; 49/38, 63, 356, 395, 505

[56] References Cited

U.S. PATENT DOCUMENTS

| | | | |
|---|---|---|---|
| 719,203 | 1/1903 | Dreyer | 160/188 |
| 751,668 | 2/1904 | Moskow | 160/97 |
| 1,100,564 | 6/1914 | Heryford | 160/97 |
| 2,013,155 | 9/1935 | Johnson | 160/40 |
| 2,243,735 | 5/1941 | Leahy | 160/188 |
| 2,311,413 | 2/1943 | Persson | 160/40 X |
| 2,374,618 | 4/1945 | Perreton | 49/356 |
| 2,625,218 | 1/1953 | Nihon | 160/37 |
| 2,650,858 | 9/1953 | Lange | 160/37 |
| 3,099,950 | 8/1963 | Christian . | |
| 3,172,166 | 3/1965 | Imbrecht | 49/505 X |
| 4,295,417 | 10/1981 | Isley . | |
| 4,392,329 | 7/1983 | Suzuki . | |
| 4,546,693 | 10/1985 | McTaw, Jr. . | |
| 4,683,687 | 8/1987 | Crider . | |
| 4,969,291 | 11/1990 | Camara | 160/97 X |
| 5,137,492 | 8/1992 | Archer et al. . | |
| 5,391,967 | 2/1995 | Domel et al. | 318/254 |
| 5,397,134 | 3/1995 | Fishman et al. | 273/448 |
| 5,413,161 | 5/1995 | Corazzini | 160/7 |
| 5,459,380 | 10/1995 | Augustinowicz | 318/483 |
| 5,566,471 | 10/1996 | Hirano | 34/201 |
| 5,760,558 | 6/1998 | Popat | 318/480 |

*Primary Examiner*—Daniel P. Stodola
*Assistant Examiner*—Bruce A. Lev
*Attorney, Agent, or Firm*—Morriss, Bateman, O'Bryant & Compagni

[57] ABSTRACT

A window for use in buildings or other enclosed areas is structured to open horizontally relative to the building or window casement and comprises a screen-like enclosure between the window casement and the window frame which limits the amount of moisture or dust that can enter through the window when in an open position. Further, the window is particularly structured to provide light, ventilation and an unobstructed view while providing a high degree of security to prevent breakage or burglary.

19 Claims, 8 Drawing Sheets

HORIZONTALLY OPENABLE WINDOW

CROSS REFERENCE TO RELATED APPLICATION

This application claims the benefit of U.S. Provisional Application No. 60/054,356, filed Jul. 31, 1997.

BACKGROUND OF THE INVENTION

1. Field of the Invention

This invention relates to windows that can be opened to provide ventilation to a room or enclosure, and specifically relates to windows which are constructed to open in an outwardly horizontal direction.

2. Description of Related Art

Windows have been known and used for centuries in buildings and other enclosed structures, such as vehicles, and most are made to open. Openable windows have typically opened either in a vertical direction or have been pivotally connected to an unmovable structure, such as a window frame or casement, so that the window can be pivotally rotated about that connection point to move part of the window outwardly and part of the window inwardly relative to the stationary structure. The common example of vertically openable windows is double hung windows. An example of rotating windows is a ventilated sky light/window which pivotally rotates about a central connection point in the casement.

While such openable windows are functional and suitable for the intended purpose of providing ventilation, they each have disadvantages or limitations which render conventional windows unsuitable for all purposes. For example, the most prevalent concern about conventional windows is their ability to be broken into. With vertically opened windows, the glass can be broken, the latch opened, and the window slid open to provide an entryway for a burglar. As a result, windows cannot be left open to provide ventilation for fear that unlawful entry may occur. The same is true of pivotally hung windows although they may provide slightly less opportunity for enabling unlawful entry.

Another great concern regarding conventional windows is the fact that if they are left open and inclement weather arises, rain or snow enters through the open window and can soak drapery, carpets, walls or nearby furniture. Further, if a wind storm arises, dust, dirt and other air-borne debris can blow into an open window and introduce the unwanted material into the building. Additionally, conventional windows are inherently unsafe because objects can be thrown out of them with possible injury to persons outside, or people can accidentally fall out of open windows. As a result, conventional openable windows are not installed in high-rise buildings, hospitals or other institutions and occupants of such structures are deprived of the benefit of natural ventilation.

Still another disadvantage of conventional windows is the fact that the manner in which the window opens may obstruct the view out of the remainder of the window. That problem is particularly true with windows that are pivotally hung since the window swings partially outward from the casement and partially inward and a portion of the window is most likely obstructing the view at one time or another. Additionally, pivotally hung windows must be installed where, or in a manner such that, the window can swing out freely without hitting bushes or trees, or without contacting furniture or fixtures within the building.

Thus, it would be advantageous to provide a window structured to be openable, while still providing security, unobstructed view, ease of installment and virtually unrestricted placement for installation.

BRIEF SUMMARY OF THE INVENTION

In accordance with the present invention, a window is structured to be openable in a horizontal direction relative to the casement of the window to provide a ventilated space about substantially the entirety of the periphery of the window. Because the window moves out horizontally from the surrounding casement, the window remains substantially in its original form so that the view out of the window is not obstructed in any. Further, the window is structured with an extendable screen-like ventilation skirt which is interconnected between the movable window and the stationary casement and is positioned substantially about the entire periphery of the movable window to provide ventilation therethrough. While the ventilation skirt allows air into and out of the periphery of the window, the window is structured to deflect and/or move fluid, such as from rain or snow, away from the movable window so that moisture is drawn away from the casement. The ventilation skirt may be structured to be non-breachable to prevent unlawful entry through the window. In addition, however, the distance that the window moves horizontally outwardly from the casement is an insufficient distance to allow human entry through the window. Thus, objects may not be thrown out the window, nor may people fall out of the window.

The window of the present invention is most advantageously structured as an entire unit comprising a window casement, the window frame holding the glass, the ventilation skirt interpositioned therebetween and the mechanism for opening and closing the window. When structured as a unit, the window can be easily installed in a building or other structure upon construction. However, the window may also be structured to be retrofittable into an existing window casing by providing an additional ventilation skirt engaging device which allows the ventilation skirt to be connected between the existing window casement and a new frame of the invention.

The window may, most suitably be structured with double panes of glass to increase the insulating effect of the window and thereby enhance the energy efficiency of the window. Alternatively, the window may be structured with one pane of glass, or more as may be considered suitable. The window may be made with frosted glass, such as is commonly used in architecture for the windows of bathrooms, and therein lies another advantage of the window of the present invention. That is, the window may be fitted with frosted glass to provide privacy, but the window may also be opened for ventilation without exposing the bathroom to outside view because of the construction of the ventilation skirt. The window may also be fitted with specialized glass, such as stained glass, which provides architectural beautification with the benefit of a window which is openable for ventilation—a feature not heretofore commonly known with stained glass windows. Further, the window may be made in any conceivable shape, such as round or diamond-shaped, and still be openable for ventilation—another advantage not heretofore known.

The window of the present invention may be installed as a conventional window in the side of a building or other structure, or the window may be installed as a skylight in the roof or ceiling of a building. The window, when installed as a skylight, provides added security not known with other conventional windows or skylights because of the structure of the ventilation skirt. Nonetheless, the window may be structured in such a way to still provide a means for opening the window for escape or ease of cleaning. The window of the present invention is also particularly suitable for installations in homes, high-rise buildings, hospitals and other institutions, and in campers, mobile homes and cars.

BRIEF DESCRIPTION OF THE DRAWINGS

In the drawings, which illustrate what is currently considered to be the best mode for carrying out the invention:

FIG. 4(*a*) is a side view in elevation of a window of the present invention installed in a wall, the window being closed;

FIG. 4(*b*) is a side view in elevation of the window shown in FIG. 4(*a*) where the window is open;

FIG. 4(*c*) is a side view in elevation of the window shown in FIG. 4(*b*), further illustrating a sleep shade element of the window;

DETAILED DESCRIPTION OF THE DRAWINGS

Figure 1:
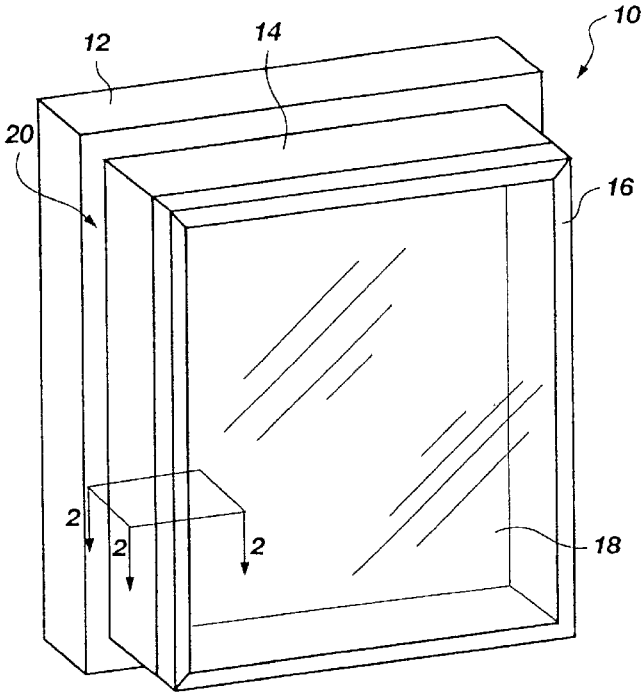
FIG. 1 is a view in perspective of the window of the present invention, showing the window in a closed position.

The window of the present invention is generally illustrated in FIG. 1 which shows a perspective view of the window 10 when installed in a wall 12. The window generally comprises a window casement 14, which fits into a preformed and appropriately sized opening in a wall 12, and a window frame 16 which is structured to support at least one pane 18 of glass. The window casement 14 may be installed to extend outwardly from the wall 12 as illustrated in FIG. 1. Alternatively, the window casement 14 may be installed to fit entirely into the wall 12 so that the window frame 16 is either flush with or extends slightly out from the exterior surface 20 of the wall 12. The depth to which the casement 14 is embedded in the wall 12 is a matter of architectural choice.

Figure 2:
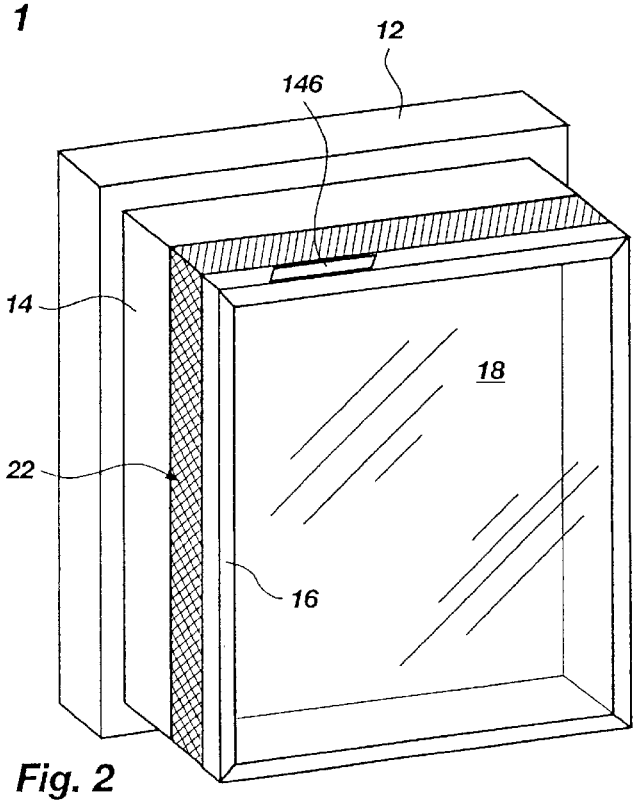
FIG. 2 is a view in perspective of the window of FIG. 1 showing the window in an open position.

FIG. 1 illustrates the window 10 in a closed position while FIG. 2 illustrates the window in an opened position. It can be seen that the window frame 16 moves horizontally outwardly from its position in registration against the window casement 14, as shown in FIG. 1. As used herein, the word "horizontal," when used to describe the opening of the window, means that the frame moves inwardly toward and outwardly from the casement in a direction which is perpendicular to the long axis of the casement. When the frame 16 is moved horizontally outwardly from the casement 14, a screen-like ventilation skirt 22 moves with the frame 16 and extends between the window casement 14 and the window frame 16. The ventilation skirt 22 extends about the periphery of the window frame 16 (i.e., about all four sides) and is preferably interconnected between the window casement 14 and the frame 16 about all four sides of the window 10. As illustrated and more fully described hereinafter, the ventilation skirt 22 is structured to move outwardly with the frame 16 as the frame 16 moves horizontally outwardly from the casement 14.

Figure 3:
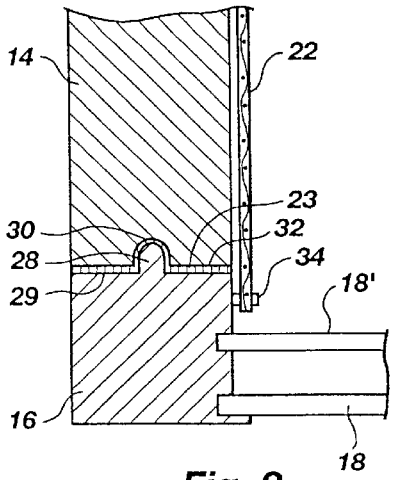
FIG. 3 is an enlarged view in cross section of a portion of the window shown in FIG. 1, taken at lines 2—2—2.

FIG. 3 illustrates how the window frame 16 registers against the casement 14 when the window 10 is closed, and illustrates one exemplar embodiment of how the screen-like ventilation skirt 22 is positioned relative to the frame 16. In one embodiment illustrated, it may be preferable that the frame 16 be structured with a bead 28 which extends outwardly from the inner facing surface 23 of the frame 16 along the length of all sides of the frame 16. The corresponding face 29 of the casement 14, against which the inner facing surface 23 of the frame 16 registers, may be structured with a channel 30, extending along the length of all sides of the casement 14, which is sized to receive the bead 28. The interlocking of the bead 28 in the channel 30 assures a secure fit of the frame 16 against the casement 14 and renders an air tight seal therebetween. The window 10 may, in addition or alternatively, be structured with a gasket 32 which extends continuously about the inner facing surface 23 of the frame 16 and registers against the casement 14. The gasket assures an airtight and water-tight seal between the frame 16 and the casement 14. As further shown in FIG. 3, the frame 16 is structured to support at least one pane 18 of glass and may support a second pane 18' of glass or additional panes.

FIG. 3 illustrates that the ventilation skirt 22 is generally positioned in parallel orientation to the casement 14 and is positioned to slide back and forth along the casement 14 as the frame 16 is opened and closed. The ventilation skirt 22 may be secured by suitable securement means 34 to the frame 16 so that as the frame 16 moves horizontally outwardly from the casement 14, the ventilation skirt 22 moves with the frame 16. The ventilation skirt 22 may also be slidably affixed to the casement 14, as described further below.

The principal structure of the window 10 of the invention is further illustrated in FIGS. 4(*a*)–4(*c*) which show a vertical cross section of an exterior wall 12 of a building with the window 10 installed therein. In this embodiment, the casement 14 is embedded in the wall 12 of the building so that the frame 16 is substantially flush with the exterior 36 of the wall 12. FIG. 4(*a*) illustrates how the window 10 appears when it is in a closed position. The frame 16 is substantially flush with the exterior 36 of the wall 12, and the casement 14 extends substantially between an interior surface 38 of the wall 12 and the exterior 36 of the wall 12 to essentially extend through the thickness of the wall 12. A mechanism 40 for moving the frame 16 to an open position is suggested in FIGS. 4(*a*) and 4(*b*) and is described more fully hereinafter. FIG. 4(*a*) also illustrates that the ventilated skirt 22 may be housed within the interior 42 of the casement 14 when the window 10 is closed.

Figures 4A, 4B, 4C, 5:
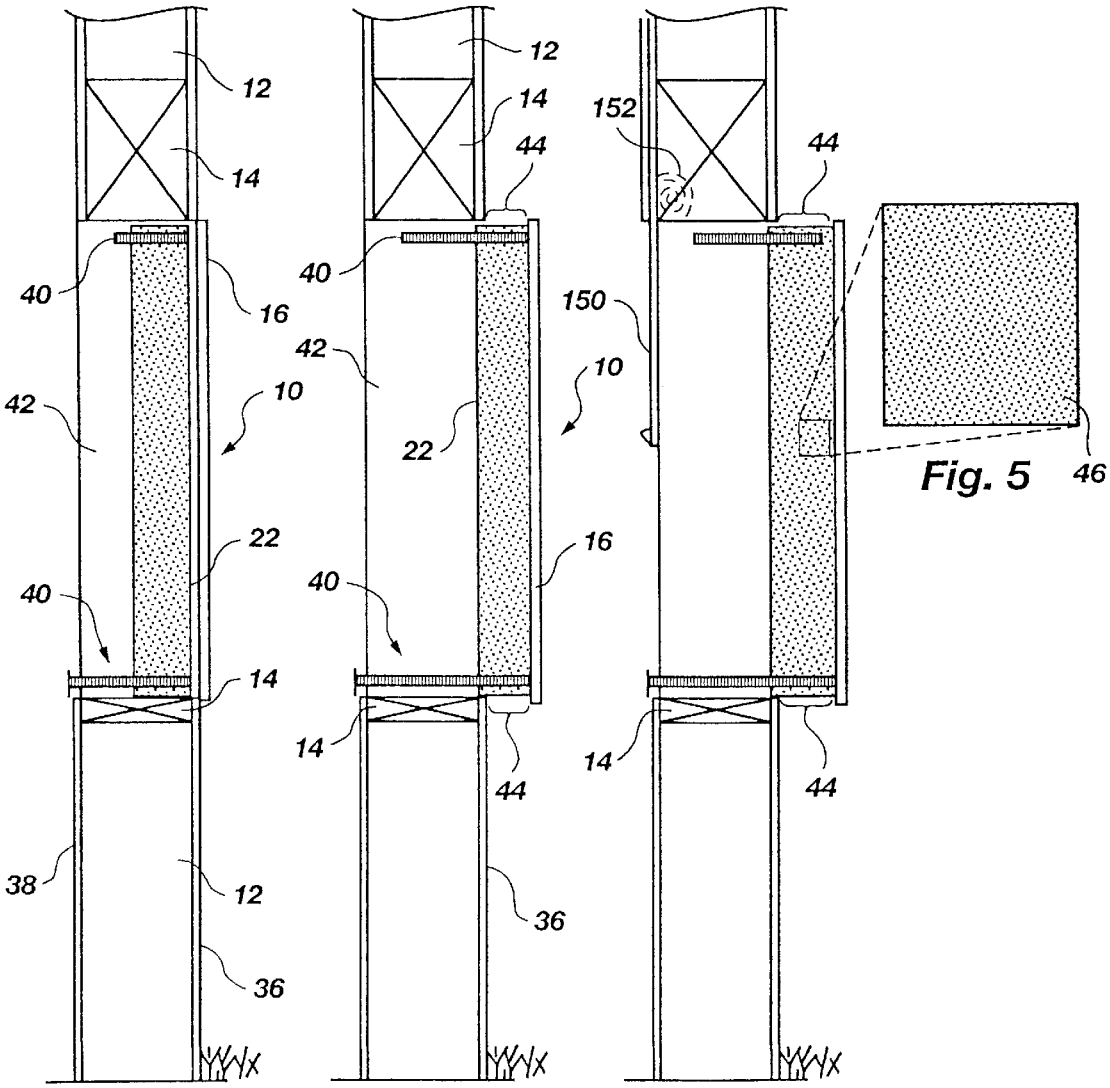
FIG. 5 is an enlarged portion of the screen shown in FIG. 4(*c*)

As shown in FIG. 4(*b*), when the frame 16 moves horizontally outwardly from the wall 12 of the building, the ventilation skirt 22 moves horizontally outwardly as well to enclose the peripheral space 44 formed between the frame 16 and the casement 14. Although not shown to scale, the window frame 16 is structured to move outwardly from the casement 14 a distance of between 0 to 8 inches. That distance is sufficient to provide significant ventilation through the ventilation skirt 22, but is insufficient to allow entry of a human therethrough. As a result the window 10 is very secure. One example of a screen-like material which may be used in the ventilation skirt 22 is shown in FIG. 5, enlarged from FIG. 4(*c*). The screen-like material 46 is a rust-proof metal of substantial thickness or strength which is quite permanent and does not require replacement. The thickness of the metal screen prevents its being tampered with in an attempt to gain entry through the window 10 and may present the most suitable type of screen-like material for use in the window 10. However, other materials may be very suitable for use in the window 10, such as polymer, aluminum or fiberglass screening material, fabric or the like.

Figure 6:
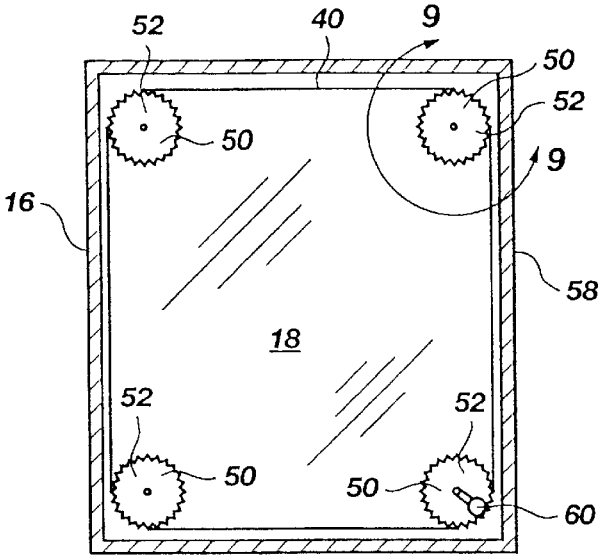
FIG. 6 is a view in elevation of the window of the present invention, looking from the inside out, and illustrating one exemplar mechanism for opening and closing the window.
Figure 7:
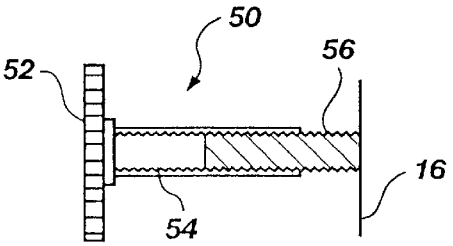
FIG. 7 is an enlarged view of a sprocket shown in FIG. 6.

The mechanism for opening and closing the window 10 in a horizontally outward manner, as previously described, may be any suitable mechanism, including manual opening means, electromechanical means or solar-powered means. One example of a very simple mechanical (non-motorized) mechanism is shown in FIGS. 6–11. In FIG. 6, the window frame 16 is shown from the back (i.e., as if looking from the interior of the building to the outside) and the casement 14 is removed. The mechanism 40 is shown in position relative to the frame 16. The mechanism 40 shown comprises a series of rotatable sprockets 50 positioned at each of the four corners of the frame 16. The sprockets 50 are shown abnormally enlarged relative to the size of the window 10 for the ease of illustration. Each sprocket 50, as shown in FIG. 7, is comprised of a flattened sprocket disk 52 which is secured to a hollow, internally threaded shaft 54 which is positioned over and threadingly engaged with a threaded pin 56, which is secured to the inside of the window frame 16.

Figure 9:
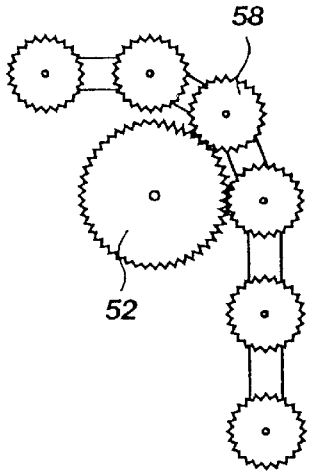
FIG. 9 is an enlarged view of the chain and sprocket shown in FIG. 6.
Figure 8:
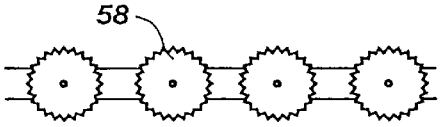
FIG. 8 is an enlarged view of the chain shown in FIG. 6.
Figure 10:
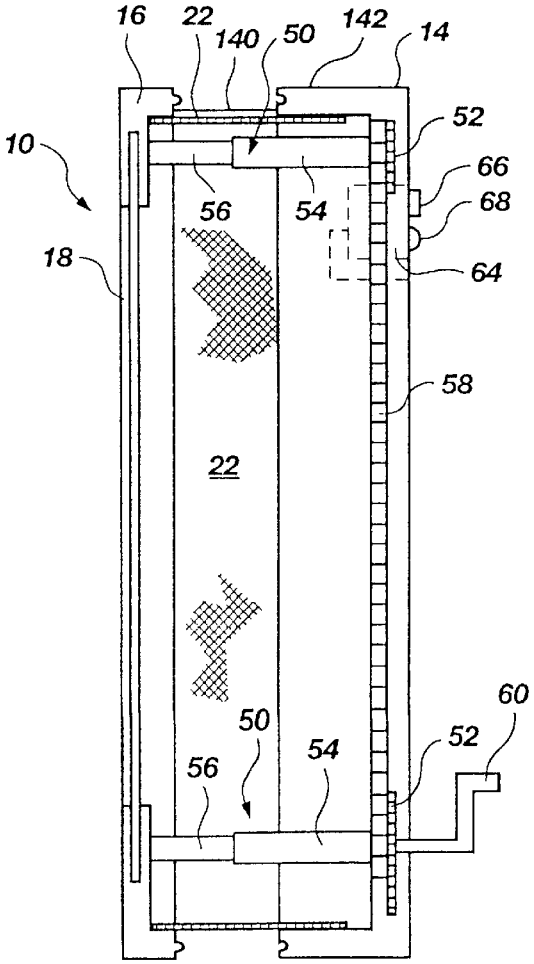
FIG. 10 is a side view in elevation of the window of the present invention illustrating the attachment and movement of the ventilation skirt.

A chain 58, as more clearly shown in FIGS. 8 and 9, extends about each of the four sprockets 50 and engages the sprocket disk 52 thereof. Thus, as one sprocket 50 is made to turn, so do all of the sprockets turn in the same direction and to the same degree. As the sprocket disk 52 of each sprocket 50 turns, the threaded shaft 54 rotates about the threaded pin 56 and either moves the disk 52 closer to the frame 16 or farther from the frame 16 to either close or open the window, respectively. As shown more fully in FIG. 10, which is a vertical cross section of the window 10, the pin 56 of each sprocket 50 is connected to the inside of the frame 16 and is threadingly engaged with the threaded shaft 54 which is connected to the sprocket disk 52. When the frame 16 is distanced from the casement 14 in the open position of the window, as shown in FIG. 10, the pin 56 is extended its full length with respect to the threaded shaft 54. In the embodiment shown in FIG. 10, the ventilation skirt 22 may be positioned on the inside of the casement 14 and frame 16 and is connected to the casement 14 and to the frame 16. A handle 60, which is rotationally connected to one of the sprocket disks 52, may be turned to rotate each of the sprocket disks 52 an equal amount, and thereby move the pin 56 of each sprocket 50 into residency within the corresponding hollow threaded shaft 54 of each sprocket 50 to thereby close the window.

Figure 11:
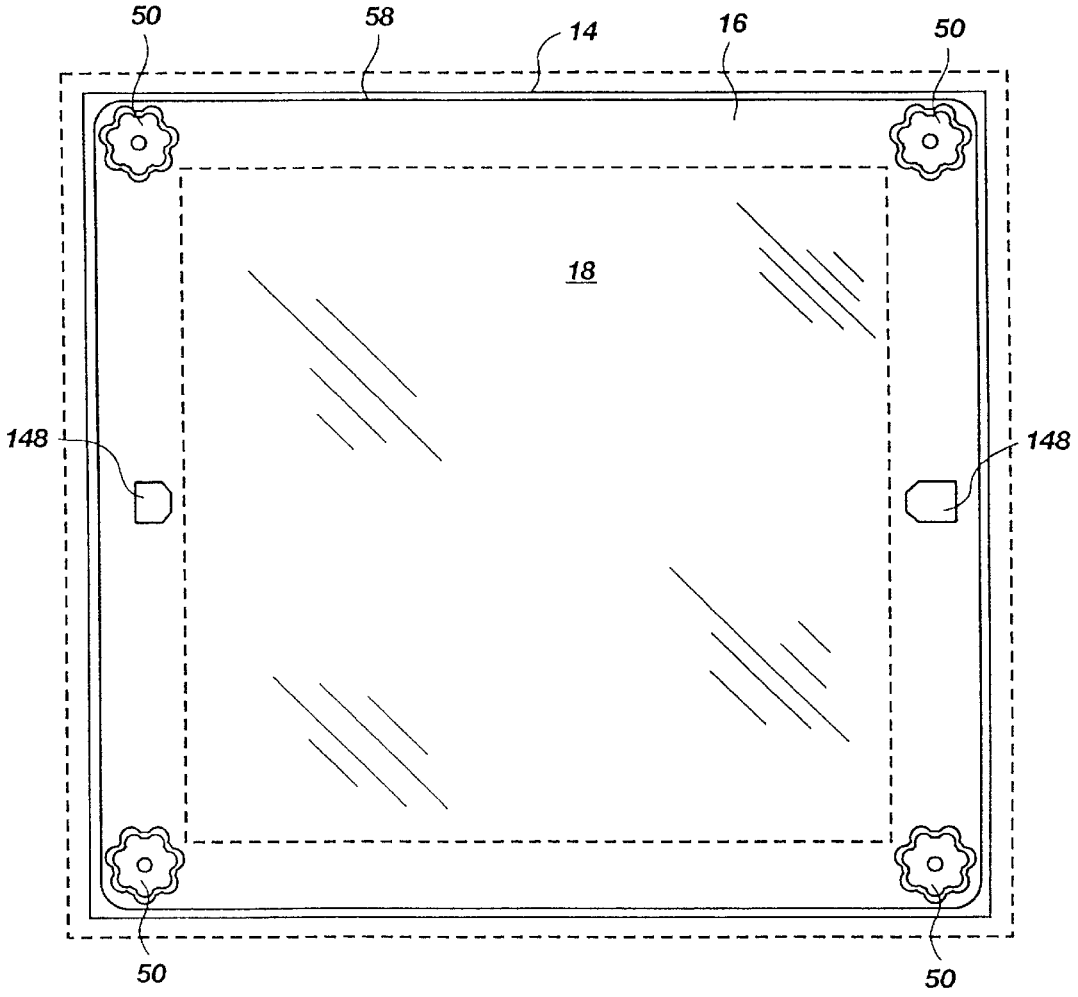
FIG. 11 is a view in elevation of the window of the present invention showing the frame in phantom so that the opening mechanism, as shown in FIG. 6 can be seen in relative proportion.

Although the mechanism 40 for opening and closing the window is shown in an enlarged fashion for ease of understanding, in actual construction, the mechanism is hidden within the structure of the frame, as shown in FIG. 11, and cannot be seen through the glass pane(s) 18 of the window 10. The frame 16 shown in FIG. 11 is a view from the front of the window 10 (i.e., looking from the outside into the interior of the building) and the frame 16 is in phantom, illustrating the relative size and placement of the sprockets 50 and chain 58 therewithin. Notably, although a handle 60 is shown in FIG. 10 as the means for manually operating the mechanism 40, the mechanism may be motorized, as suggested by the motor 64 shown in phantom in FIG. 10, so that the push of a button 66 will engage the motor with the sprockets and cause the window to open or close a selected amount. Further, the mechanism heretofore described, or any other suitable mechanism (such as described hereinafter) may be interconnected to a solar-powered battery or motorized system which can be programmed to automatically open and close the windows throughout the day responsive to the amount of sunlight detected by a light-sensitive monitor 68, shown in FIG. 10.

Figure 12:
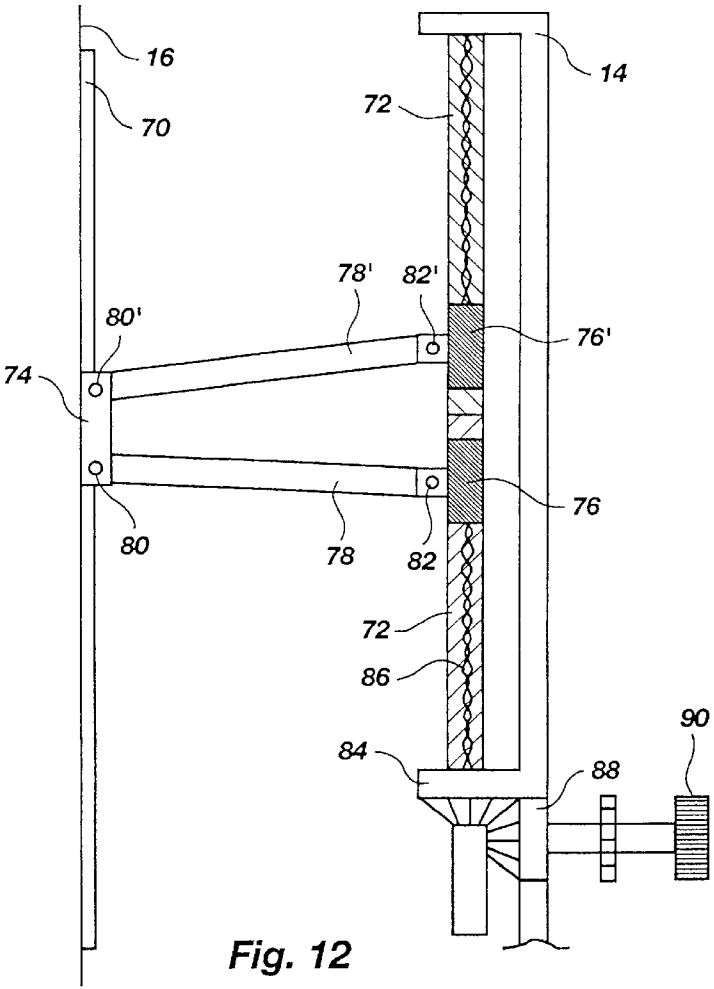
FIG. 12 is a partial side view in elevation of an alternative apparatus for opening and closing the window of the present invention.

An alternative means of opening and closing the window is schematically shown in FIGS. 12–16 where, as shown in FIG. 12, the mechanism comprises a first stationary track 70 positioned against the inside surface of the window frame 16 along at least a portion of the length of the two vertical, or the two horizontal, sides of the frame 16. A second stationary track 72 is secured to the corresponding two vertical, or two horizontal, sides of the inside surface of the casement 14. A bracket 74 is secured in place on the first stationary track 70, preferably in the center of the track 70. Two movable brackets 76, 76' are slidingly engaged on the second stationary track 72 and are slidingly movable therealong. Two legs 78, 78' are each pivotally connected, at points 80, 80', to bracket 74 and are each pivotally secured, at points 82, 82', to one of the sliding brackets 76, 76'. A first rotatable wheel 84 is attached to a chain 86 or other movable guide means which is attached to the movable brackets 76, 76' along the second stationary track 72. The first rotatable wheel 84 is engaged by a sprocket gear or toothed gear arrangement with a second rotatable wheel 88 which may be turned by a handle 90. The handle 90 extends outwardly from the casement 14 for grasping by a user. As the handle 90 is turned, the second rotatable wheel 88 is caused to turn, which in turn causes the first rotatable wheel 84 to turn and thereby moves the chains 86 which move the slidable brackets 76, 76'. As the brackets 76, 76' move away from each other along the second stationary track 72, the legs 78, 78' pivot about their connections 80, 80' and 82, 82' to separate from each other.

Figure 14:
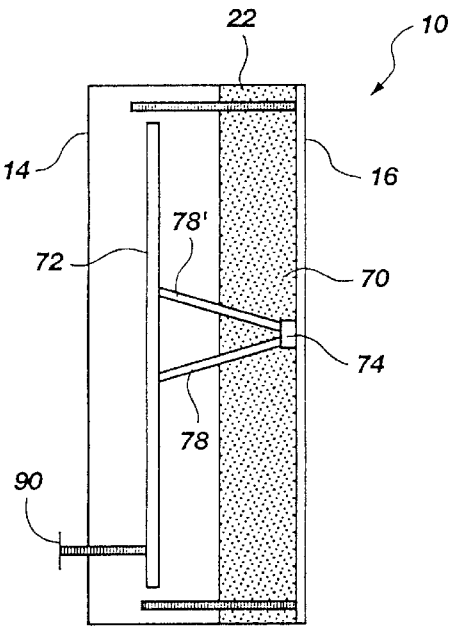
FIG. 14 is a simplified side elevation view of the mechanism shown in FIG. 12 when the window is open.
Figure 13:
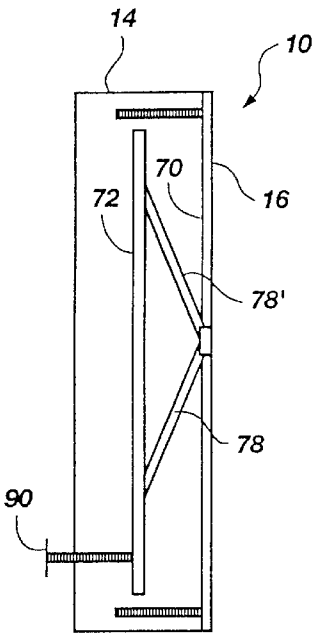
FIG. 13 is a simplified side elevation view of the mechanism shown in FIG. 12 when the window is closed.

Illustrated more fully in FIGS. 13 and 14, as the legs 78, 78' are moved farther apart, the first stationary track 70 connected to the frame 16 is moved closer to the second stationary track 72 connected to the casement 14 and the window 10 is brought into a closed position. Conversely, as shown in FIG. 14, as the legs 78, 78' are moved closer together, the first stationary track 70 connected to the frame 16 is moved farther apart from the second stationary track 72 connected to the casement 14 and the window 10 is moved horizontally outwardly to an open position with the ventilation skirt 22 extended outwardly between the casement 14 and the frame 16.

Figure 15:
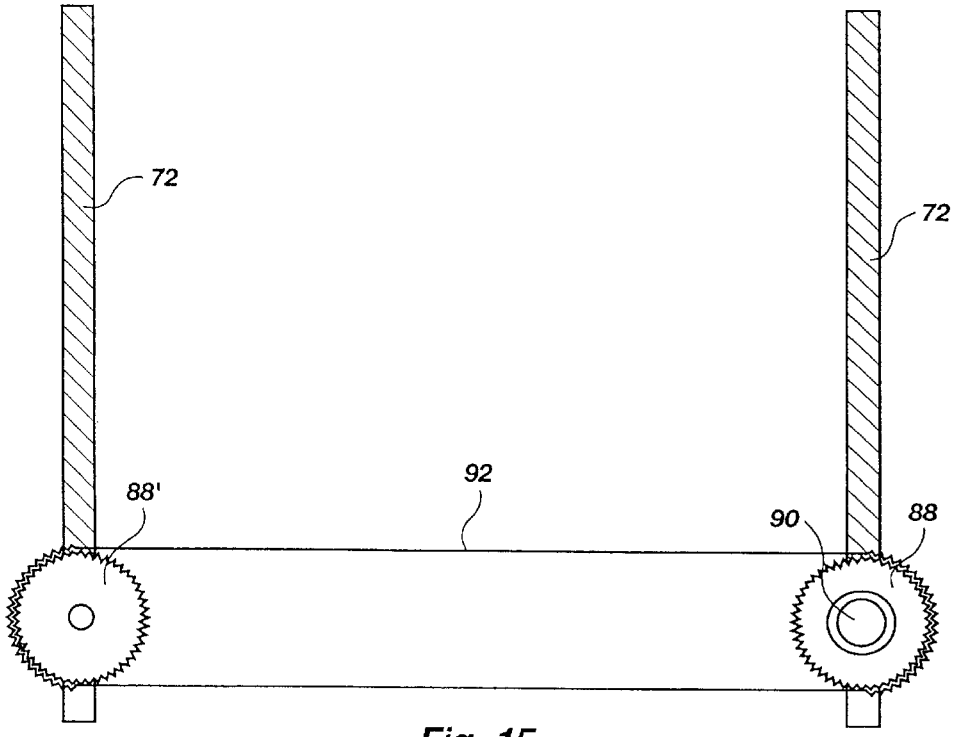
FIG. 15 is a partial view of two mechanisms, as shown in FIG. 12, which are linked together for coordinated movement of the frame of the window.

FIG. 15 illustrates how two second stationary tracks 72, positioned along, for example, the vertical sides of the casement (not shown) can be effectively interconnected for operation of the opening and closing of the mechanism by interconnecting geared wheels 88, 88' associated with each second stationary track 72 with a chain 92 or other suitable guiding and moving device. Therefore, as one of the geared wheels 88 is rotated by handle 90 to cause the movable brackets 76, 76' and legs 78, 78' (not shown) to move, the chain 92 simultaneously causes the other geared wheel 88' to rotate at the same rate to effect an equal movement of the movable brackets 76, 76' and legs 78, 78' (not shown) associated with that geared wheel 88. As previously noted, the mechanism may be moved manually by the use of a handle 90 or may be motorized. The mechanisms described herein for opening and closing the frame relative to the casement are by way of example only and do not represent the only contemplated ways of carrying out the intended function. Numerous other methods and mechanisms may be employed to move the frame.

Figure 16:
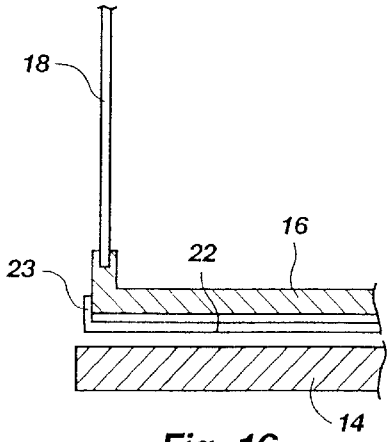
FIG. 16 is an enlarged partial view in cross section of an alternative embodiment of the window of the present invention showing another exemplar means of attaching the ventilation skirt to the frame.
Figure 17:
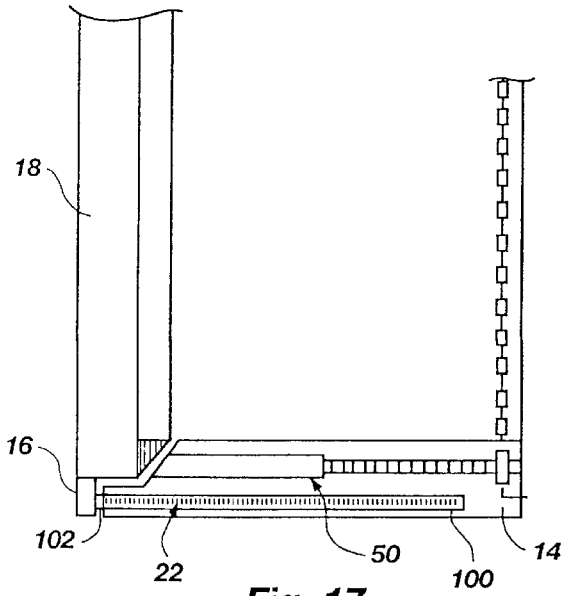
FIG. 17 is an enlarged partial view of another alternative embodiment of the window of the present invention showing another exemplar means of attaching the ventilation skirt to the frame.

The ventilation skirt 22 is shown in FIGS. 2, 3 and 10 as being positioned within the frame 16 and the casement 16. However, as shown in FIG. 16, the window may be structured in an alternative embodiment to position the frame 16 within the casement 16 so that a lip 23 of the ventilation skirt 22 extends around and is secured to the front of the frame 16. Thus, as the frame 16 moves horizontally outwardly from the casement 14, the ventilation skirt 22 is moved outwardly with the frame 16. Conversely, as the frame 16 retracts into the casement 14, the ventilation skirt 22 moves with the frame 16 back into the casement 14 where it is obstructed from view. In yet another alternative embodiment shown in FIG. 17, the ventilation skirt 22 may be slidably positionable in a channel 100 which is formed in the side of the casement 14 and extends along the length of all sides of the casement 14. The leading end 102 of the ventilation skirt 22 is connected to the inside surface of the frame 16. As the frame 16 moves horizontally outwardly from the casement 14, as previously described, the ventilation skirt 22 is pulled out of the channel 100 and extends between the frame 16 and the casement 14. Upon closing the window 10, the retraction of the frame 16 toward the casement 14 causes the ventilation screen 22 to slide into the channel 100 for storage.

Figure 18:
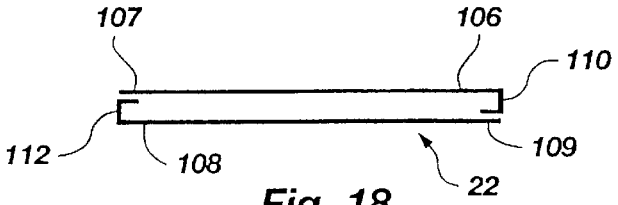
FIG. 18 is a simplified view of another means of forming the ventilation skirt in two pieces, the two pieces being shown in the window-closed position.
Figure 19:
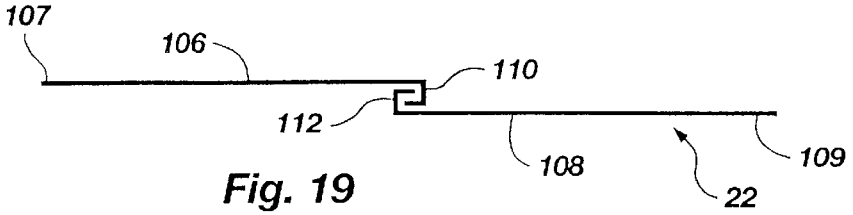
FIG. 19 is a simplified view of the two pieces shown in FIG. 18, with the window frame open.
Figure 20:
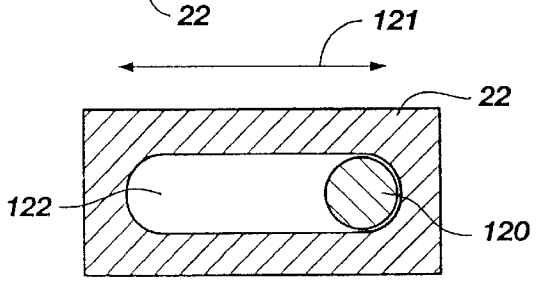
FIG. 20 is a partial view of an alternative means for opening and closing the ventilation skirt.
Figure 24:
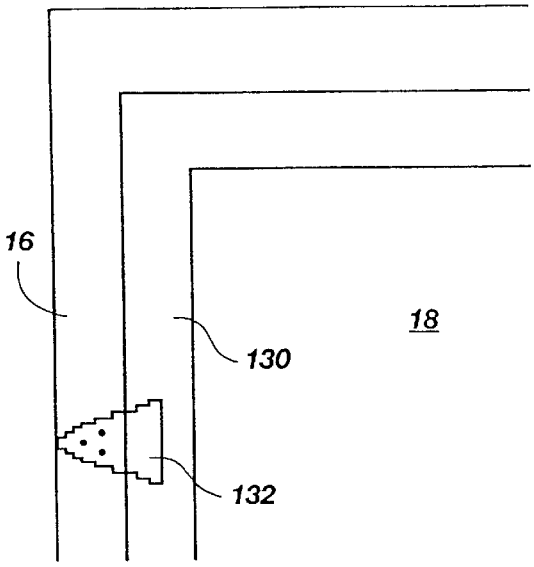
FIG. 24 is an enlarged view showing the hinges joining the subframe to the frame.
Figure 25:
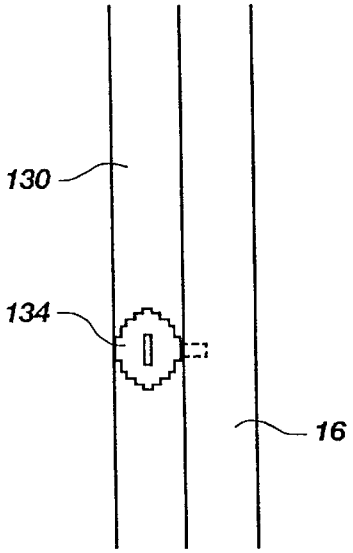
FIG. 25 is an enlarged view showing the locking mechanism positioned between the frame and subframe.

The ventilation skirt 22 is represented in FIGS. 2, 4 and 10 as a single width of screen-like material (the width being measured between the connection point of the ventilation skirt 22 to the casement 14 and its connection point to the frame 16). However, it may be more suitable that the ventilation skirt 22 be comprised of two or more interlocking widths of material which enable the ventilation skirt 22 to collapse width-wise upon itself for more convenient positioning and storage within the frame/casement structure (i.e., when the window 10 is closed). This principal is illustrated in FIGS. 18 and 19 where the ventilation skirt 22, shown in lateral cross section, is comprised of a first width of screen 106 and a second width of screen 108 each of which has a turned edge 110, 112. The terminal end 107 of the first width of screen 106 may, for example, be secured to the frame of the window while the terminal end 109 of the second width of screen 108 is secured to the casement 14. When the window is closed, as represented in FIG. 18, the two widths of screen 106, 108 are positioned adjacent one another in parallel spaced apart arrangement with the turned edges 110, 112 at opposing orientations. When the window is open, as represented in FIG. 19, the two widths 106, 108 are pulled away from each other in opposing directions and the turned edges 110, 112 interlock to prevent the two widths from moving farther apart. In an alternative embodiment suggested in FIG. 20, the ventilation skirt 22, only a portion of which is shown, may be allowed to move laterally (in the direction of arrow 121) relative to the frame and casement by a stop pin 120 connected to the sides of either the casement or the frame, the stop pin 120 being positioned to slide within a closed, elongated aperture 122 formed in the ventilation skirt 22.

Figure 21:
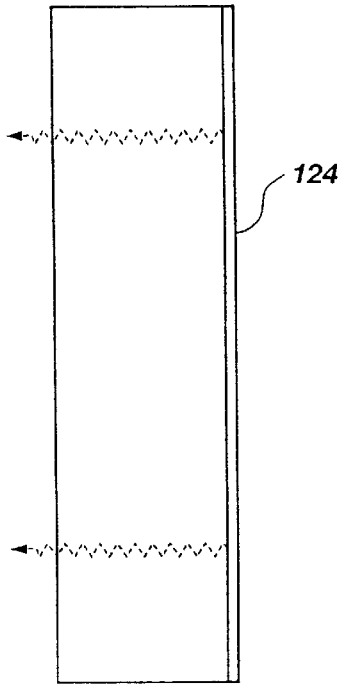
Fig. 21 (PRIOR ART)
FIG. 21 is a side view of a conventional window illustrating the entry of radiant heat into the window pane.
Figure 22:
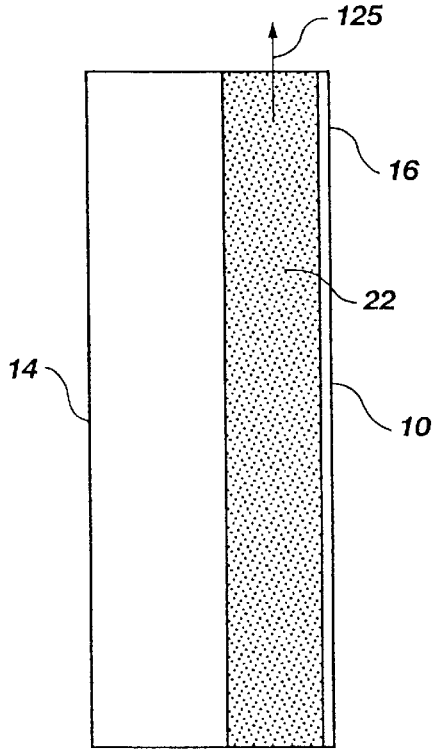
FIG. 22 is a side view in elevation of the window of the present invention illustrating the dissipation of heat from the ventilation skirt.
Figure 23:
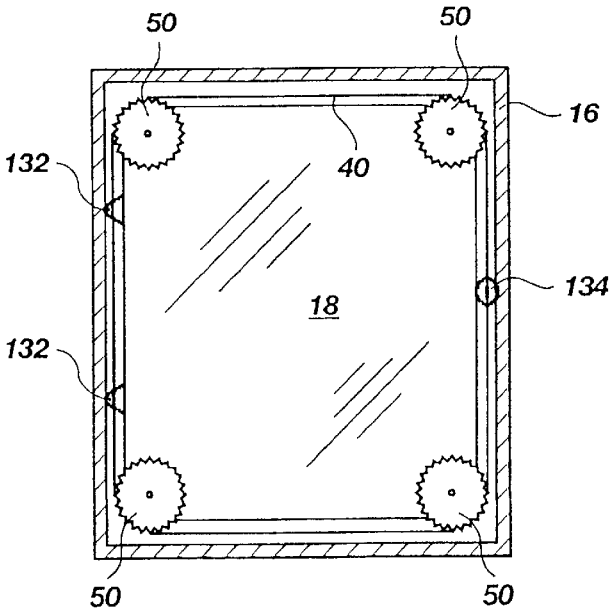
FIG. 23 is a rear view of an alternative form of the window of the present invention illustrating a subframe that opens relative to the frame.
Figure 26:
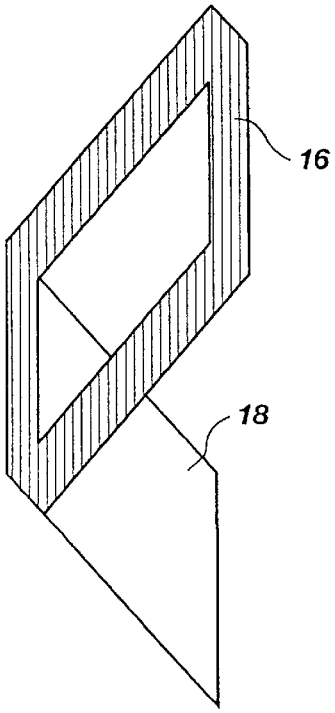
FIG. 26 is a perspective view of the embodiment shown in FIG. 23 illustrating the window pane being openable relative to the frame.

Other advantages of the present invention are illustrated in FIGS. 21 and 22 where it is shown that the radiant heat filters through the glass 124 of conventional windows, as shown in FIG. 23, to heat the room. While some heat is welcomed, a room can become overly heated by the number and position of the windows which are subjected to the radiant heat. With the window 10 of the present invention, represented in FIG. 22, a portion of the radiant heat will dissipate through the ventilation skirt 22, in the direction of arrow 125, thereby acting as a natural air conditioner.

Further, as shown in FIGS. 23–26, the window 10 may be structured with a latch mechanism which allows the glass pane 18 to be separated, at least in part, from the frame 16 so that the window 10 can be used as a means for escape. In particular, the frame 16 may be structured with a fitted movable subframe 130 (FIG. 24) which registers at all times against the main frame 16 structure. The glass pane 18 (or panes) is embedded in the subframe 130. One or more hinges 132 may extend between the frame 16 and subframe 130 (FIGS. 23 and 24) and an unlockable latch 134 (FIGS. 23 and 26) may secure the subframe 130 to the frame 16 at a point opposite from the hinges 132 (FIG. 23). The latch 134 is only accessible from inside the building and is not accessible from the outside by unwanted intruders. In an emergency, the latch 134 may be unlocked from the inside, and the subframe 130 and glass pane 18 may be swung outwardly from the frame 16 (FIG. 26) to provide egress from the building. Alternatively, the subframe 130 may be pivotally connected to the main frame structure so that the glass can be rotated inwardly for easy cleaning.

As suggested by FIG. 10, the window 10 of the present invention may preferably be structured with a solid plate 140, such as of aluminum or steel material, which extends outwardly from the casement 14 along with the ventilation skirt 22 when the frame 16 moves horizontally outwardly from the casement 14. The solid plate 140 is thus sized in dimension to approximate the size and dimension of the ventilation skirt 22 positioned beneath and parallel to the solid plate 140. The solid plate 140 is positioned along the top side 142 of the window 10 so that it is exposed to rain and snow. Thus, if the window is left open during inclement whether, the solid plate 140 will deflect any moisture away from the ventilation skirt 22 and prevent moisture from getting into the window. Additionally, a moisture sensor device 146 (shown in FIG. 2) may be connected to the frame 16 for detecting the occurrence of rain or snow. The moisture sensor device 146 may, in turn, be connected to the closing mechanism of the window and when rain or snow is detected, a signal is sent to the closing mechanism to cause the window to close.

Other features which may be incorporated into the window of the present invention include a security alarm which sets off an alarm if the window is tampered with from the outside. For example, as shown in FIG. 11, two appropriately aligned light-emitting detectors 148 may be installed within the side of the frame 16 or casement 14 to produce a light beam therebetween. If the window is tampered with or broken, the light beam is broken or disturbed and an alarm sounds to frighten the intruder and alert the residents. A further feature of the window is a sleep shade 150, as illustrated in FIG. 4(*c*). That is, the window may be structured with a slidable, retractable shade 150 which can be moved to cover the window from inside the building. The shade 150 may be configured to slide within a pocket formed in the wall of the building or, alternatively, the shade 150 may be kerfed so that it rolls about a journalled rod 152 positioned within the casement 14 of the window 10.

The window of the present invention is designed to maximize all of the benefits of windows, such as light, view and ventilation, while still providing security, ease of installation and ease of use. The window can be adapted to use in both buildings and residences, and can even be adapted for use in other enclosed spaces, such as cars, trains, and other modes of transportation. The window can be used as a conventional vertically-hung window is used, or can be adapted for use as a sky-light or similar device. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A window comprising:

a window casement for positioning in a wall or roof of a structure, said window casement having a plane oriented parallel to said wall or roof;

a frame for containing at least one pane of glass and having four peripheral, continuous sides, said frame being movable in a direction normal to said plane of said window casement to provide an opening therebetween of equal dimension about all said peripheral sides;

apparatus for moving said frame in said direction relative to said casement comprising at least one pin attached to said frame, said pin being telescopingly received in a hollow shaft for effecting selectivity adjustable movement of said at least one pin relative to said hollow shaft in a direction normal to said plane of said window casement to produce movement of said frame in a direction normal to said plane of said window casement; and a variably extendable ventilation skirt positioned between said casement and said frame about said four peripheral, continuous sides thereof to enclose said opening formed between said casement and said frame when said window is in an open position, said ventilation skirt being of fixed extended length equal to said dimension of said opening about all four peripheral, continuous sides of said frame.

2. The window of claim 1 further comprising at least one tooth-bearing sprocket configured to engage a chain and connected to said pin and hollow shaft to effect movement of said frame.

3. The window of claim 2 wherein movement of said frame is imparted manually by the turn of a handle secured to said hollow shaft.

4. The window of claim 2 wherein movement of said frame is imparted by operation of a motor in electrical communication with said at least one sprocket.

5. The window of claim 4 further comprising a light sensor for detecting an amount of sunlight which, in turn, operates said motor to open or close said frame in accordance with a detected amount of sunlight.

6. The window of claim 4 further comprising a moisture sensor for detecting an increase in moisture about the window, said moisture sensor being in electrical communication with said motor to close said frame relative to said window casement upon a detection of increased moisture.

7. The window of claim 1 wherein said apparatus for moving said frame relative to said window casement includes a motor for effecting movement of said frame.

8. The window of claim 7 wherein said motor is solar powered.

9. The window of claim 7 further comprising a light sensor for detecting an amount of sunlight which, in turn, operates said motor to open or close said frame in accordance with a detected amount of sunlight.

10. The window of claim 7 further comprising a moisture sensor for detecting an increase in moisture about the window, said moisture sensor being in electrical communication with said motor to close said frame relative to said window casement upon a detection of increased moisture.

11. The window of claim 1 wherein said ventilation skirt is made of stiffened screen-like material.

12. The window of claim 1 wherein said ventilation skirt is made of screen-like fabric.

13. The window of claim 1 further comprising a gasket seal between said frame and said window casement about all four peripheral, continuous sides of said frame for providing an air-tight and water-tight seal therebetween when the frame is in registration against the window casement.

14. The window of claim 1 wherein said apparatus for moving said frame relative to said window casement comprises a first stationary track, connected to either said frame or said window casement, and a second track, connected to the other of said frame or said window casement, said first stationary tract and said second track being interconnected by at least one movable arm stationary secured relative to said second track to adjust the position of said first stationary track relative to said second track to effect opening and closing of said window.

15. The window of claim 1 further comprising a solid plate connected to a top of said frame and being coextensive with said ventilation skirt at the top of said frame when said frame is open relative to said window casement.

16. The window of claim 1 further comprising a shade retractable within said window casement.

17. The window of claim 1 further comprising an electronic eye device positioned relative to said frame to detect attempted entry through the window.

18. The window of claim 1 wherein said frame is further configured with a subframe positioned within said four peripheral, continuous sides of said frame and having subframe peripheral sides to retain at least one pane of glass therein, said subframe being sized to provide registration between said subframe peripheral sides and said four peripheral, continuous sides of said frame, and said subframe being hingedly movable relative to one of said four peripheral, continuous sides of said frame.

19. The window of claim 18 wherein said subframe is releasably locked into registration with said frame.

* * * * *